US010507483B2

(12) United States Patent
Fritz et al.

(10) Patent No.: US 10,507,483 B2
(45) Date of Patent: Dec. 17, 2019

(54) COATING METHOD AND CORRESPONDING COATING INSTALLATION

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Timo Beyl, Besigheim (DE); Moritz Bubek, Ludwigsburg (DE)

(73) Assignee: DÜRR SYSTEMS AG, Bietigheim-Bissingen (DE)

( * ) Notice: Subject to any disclaimer, the term of this patent is extended or adjusted under 35 U.S.C. 154(b) by 161 days.

(21) Appl. No.: 15/531,304

(22) PCT Filed: Nov. 4, 2015

(86) PCT No.: PCT/EP2015/002215

§ 371 (c)(1),
(2) Date: May 26, 2017

(87) PCT Pub. No.: WO2016/087016

PCT Pub. Date: Jun. 9, 2016

(65) Prior Publication Data

US 2017/0341098 A1 Nov. 30, 2017

(30) Foreign Application Priority Data

Dec. 1, 2014 (DE) ..... 10 2014 017 707

(51) Int. Cl.
*B05B 13/04* (2006.01)
*B05B 12/08* (2006.01)
*B05D 1/02* (2006.01)

(52) U.S. Cl.
CPC ..... *B05B 13/0431* (2013.01); *B05B 12/082* (2013.01); *B05B 13/0421* (2013.01); *B05B 13/0452* (2013.01); *B05D 1/02* (2013.01)

(58) Field of Classification Search
None
See application file for complete search history.

(56) References Cited

U.S. PATENT DOCUMENTS 4,239,431 A 12/1980 Davini
4,300,198 A 11/1981 Davini
(Continued)

FOREIGN PATENT DOCUMENTS

DE 10 2010 004 496 A1 7/2011
DE 102010004496 A1 * 7/2011 ..... B05B 12/124
(Continued)

OTHER PUBLICATIONS

Search Report from State Intellectual Property Office of the People's Republic of China for Application No. 201580065058.7 dated Dec. 11, 2018 (2 pages; English translation).
(Continued)

*Primary Examiner* — Michael P. Rodriguez
(74) *Attorney, Agent, or Firm* — Bejin Bieneman PLC

(57) ABSTRACT

A coating method for coating components, e.g. motor vehicle bodywork components in a painting installation, is provided. The coating method includes moving an application device over a component surface to be coated along a pre-determined coating path, and applying a coating medium stream onto the component surface by means of an application device. The coating medium stream is not rotationally symmetrical relative to its stream axis and therefore generates on the component surface an elongate spray pattern with a particular longitudinal direction. The method further includes rotation of the application device about the stream axis relative to the coating path during the movement of the application device so that the angular position of the longitudinal direction of the spray pattern relative to the path transverse direction changes along the coating path.

10 Claims, 4 Drawing Sheets

(56) References Cited

U.S. PATENT DOCUMENTS

| | | | | |
|---|---|---|---|---|
| 2014/0220231 | A1* | 8/2014 | Fischer | B05B 12/082 427/8 |
| 2015/0375258 | A1 | 12/2015 | Fritz et al. | |

FOREIGN PATENT DOCUMENTS

| | | | | |
|---|---|---|---|---|
| DE | 10 2011 114 382 | A1 | 3/2013 | |
| DE | 10 2013 002 412 | A1 | 8/2014 | |
| EP | 0007207 | A1 | 1/1980 | |
| JP | S5440840 | A | 3/1979 | |
| JP | S5467214 | A | 5/1979 | |
| JP | S594772 | Y2 | 2/1984 | |
| JP | 3313949 | B2 | 8/2002 | |
| WO | WO-2013041184 | A1 * | 3/2013 | B05B 12/082 |

OTHER PUBLICATIONS

International Search Report and Written Opinion for PCT/EP2015/002215 dated Feb. 10, 2016 (13 pages; with English translation).

* cited by examiner

COATING METHOD AND CORRESPONDING COATING INSTALLATION

CROSS-REFERENCE TO RELATED APPLICATIONS

This application is a national stage of, and claims priority to, Patent Cooperation Treaty Application No. PCT/EP2015/002215, filed on Nov. 4, 2015, which application claims priority to German Application No. DE 10 2014 017 707.6, filed on Dec. 1, 2014, which applications are hereby incorporated herein by reference in their entireties.

BACKGROUND

The present disclosure relates to a coating method for coating components, in particular for coating motor vehicle bodywork components in a painting installation. The present disclosure also relates to a corresponding coating installation.

In the painting of motor vehicle bodywork components, rotary atomisers which emit a rotationally symmetrical coating medium stream and accordingly generate a rotationally symmetrical spray pattern on the component surface are mostly used as the application device. The angular orientation of such a rotary atomiser in relation to the longitudinal axis of the coating medium stream generally plays no part herein, since the coating medium stream is rotationally symmetrical. Exceptionally, however the angular position of the rotary atomiser can have an effect if the coating medium stream is asymmetrically blown by steering air, which then results in a correspondingly asymmetrical spray pattern on the component surface. Previously, however, no attempt has been made specifically to influence the angular position of the rotary atomiser during operation.

However, other application devices are also known from the prior art (e.g. DE 10 2013 002 412 A1) which apply a coating medium stream that is not rotationally symmetrical and therefore creates a spray pattern on the component surface that is not rotationally symmetrical.

Figure 7:
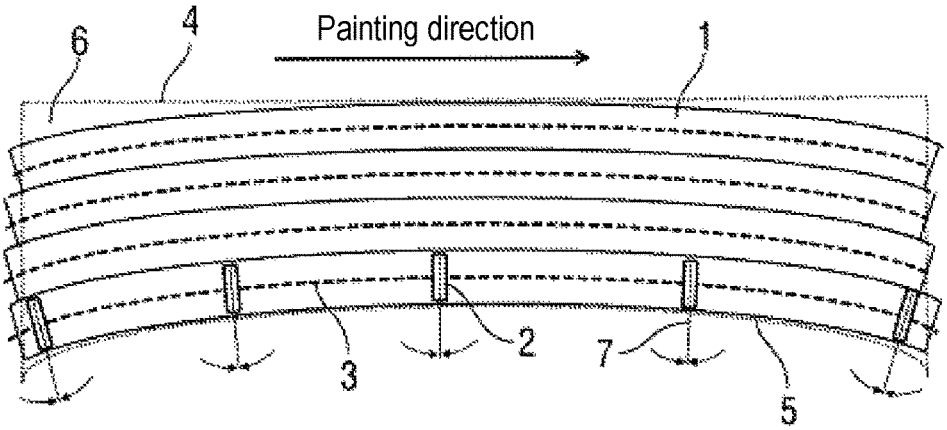
Fig. 7 Prior art

This can be problematic if such application devices are used to coat a component surface in that a plurality of adjacently placed coating paths 1 are applied onto the component surface, as shown in FIG. 7. The coating paths 1 must herein directly abut one another as far as possible without gaps and without overlaps, since the application device emits a rectangular, sharp-edged spray pattern 2. The coating paths 1 therefore have a path course 3 which extends parallel between the adjacently placed coating paths 1 so that the adjacent coating paths 1 abut one another overlap-free and without gaps. However, this leads to problems if the component to be coated is bordered by two component edges 4, 5 that do not extend parallel to one another. Thus, FIG. 7 shows a straight component edge 4 and a curved component edge 5, wherein the coating paths 1 conform to the curved component edge 5, which leads in the region of the other component edge 4 to uncoated regions 6. It should be noted herein that the application device is not rotated during the movement along the path course 3, so that the spray pattern 2 is always oriented with its longitudinal direction 7 perpendicular to the path course 3 and thus parallel to the path transverse direction. This orientation of the spray pattern 2 leads to a maximum path width of the coating path 7.

Figure 8:
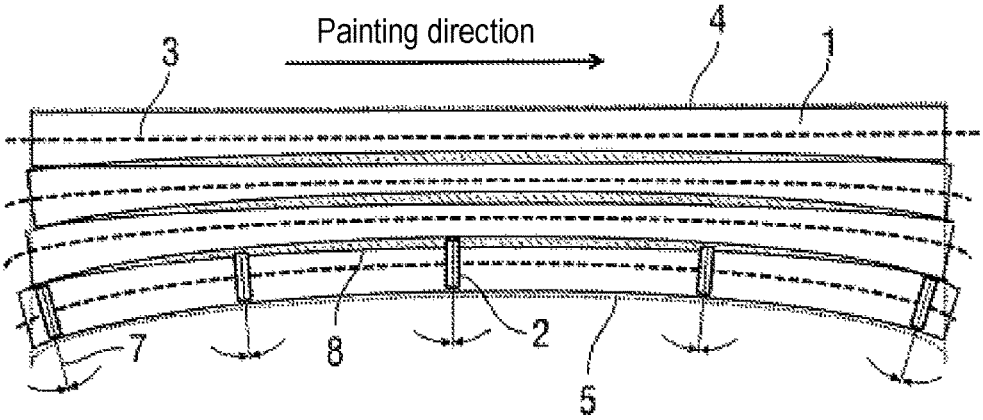
Fig. 8 Prior art

The problem of the uncoated regions 6 according to FIG. 7 can be solved in that the individual coating paths 1 do not extend exactly parallel to one another, as shown in FIG. 8, wherein in FIG. 8, corresponding details are provided with the same reference signs as in FIG. 7. Thus the lower coating paths 1 are herein curved and conform to the lower component edge 5. Toward the top, the coating paths 1 are then increasingly straight and thus increasingly conform to the upper component edge 4. In this way, the uncoated regions 6 are prevented. However, this leads to overlaps between adjacent coating paths 1 and thereby to overcoated regions 8 with a correspondingly excessive layer thickness, which is also undesirable. Herein also the application device is not rotated during the movement along the path course 3, so that the spray pattern 2 is always oriented with its longitudinal direction 7 perpendicular to the path course 3 and thus parallel to the path transverse direction.

Regarding the general technical background, reference is also made to DE 10 2011 114 382 A1. This document discloses a coating method in which the spray stream is tilted relative to the component surface during the painting in order to compensate for asymmetries. However, this is not useful for the painting of paths which are not exactly rectangular.

It would be desirable to prevent both the uncoated regions 6 and the overcoated regions 8 on such component surfaces when an application device is used which applies a rotationally asymmetrical coating medium stream generating an elongate spray pattern with a particular longitudinal direction.

SUMMARY

According to the present disclosure, an application device is provided that is guided along a pre-determined coating path over a component surface to be coated. During this movement, the application device emits a coating medium stream onto the component surface, wherein the coating medium stream is not rotationally symmetrical relative to its stream axis and therefore generates on the component surface an elongate spray pattern with a particular longitudinal direction. For example, the spray pattern can be approximately rectangular. With such an elongate spray pattern, the angular position of the application device relative to the path course is not insignificant, as is the case, e.g., with rotary atomisers having symmetrical spray patterns.

The present disclosure therefore provides that during the movement over the component surface, the application device is rotated about the stream axis, so that the angular position of the longitudinal direction of the spray pattern relative to the path transverse direction or relative to the path course changes along the coating path. In this way, the width of the applied coating path can be changed along the coating path.

In order to reach a maximum path width, the application device is rotated so that the longitudinal direction of the spray pattern is oriented perpendicularly to the path course, since the spray pattern then coats the component surface with its maximum width.

By contrast, in order to reach a minimum path width of the coating path applied, the application device is rotated so that the longitudinal direction of the elongate spray pattern extends parallel to the path course, since the elongate spray pattern then coats the component surface with its smaller width.

The rotation of the application device during the movement of the application device along the coating path thus enables a continuous adjustment of the width of the coating path between a maximum value and a minimum value. The maximum value of the path width of the coating path is herein determined by the longitudinal extent of the spray pattern along the longitudinal direction of the spray pattern. The minimum value of the path width of the coating path, however, is determined due to the transverse extent of the elongate spray pattern transversely to its longitudinal extent. Within these limits which are determined by the maximum value and the minimum value, the path width can be steplessly, e.g. substantially continuously, adjusted by means of a suitable rotation of the application device.

The expression of a rotation of the application device used in the context of the present disclosure, in some implementations, relates to the whole application device which is rotated. To be distinguished therefrom is, for example, the rotation of the bell cup in a conventional rotary atomiser. According to the present disclosure, the rotation of the application device results in a corresponding rotation of the spray pattern on the component surface.

The rotation angle of the application device in relation to the path course may influence the coating layer thickness. If the application device is rotated so that the maximum path width is achieved, this leads to a minimum layer thickness if the other coating parameters remain unchanged. If the application device is rotated so that the path width is a minimum, this leads to a maximum layer thickness if the other coating parameters remain unaffected.

In some implementations of the present disclosure, the influence of the rotation angle is compensated for in order to achieve a constant layer thickness. In other implementations, dependent upon the permissible layer thickness tolerance, it may not be necessary to compensate for the slice thickness deviations through the rotation of the applicator.

In some implementations, compensation for the effect of the rotation angle on the layer thickness is provided by adjusting the movement speed of the application device accordingly along the coating path. If the application device is rotated so that a maximum path width of the coating path and a corresponding minimum layer thickness are achieved, then the reduction of the coating thickness is compensated for by a slowing of the movement speed. If, however, the application device is rotated so that a minimum path width and a corresponding maximum coating thickness are achieved, then the increase of the coating thickness is avoided by a corresponding increase of the movement speed.

In other implementations, compensation for the effect of the rotation of the application device on the layer thickness is provided by adjusting the coating medium flow. If the application device is rotated so that the path width is a maximum and the layer thickness is correspondingly minimal, then the lowering of the layer thickness can be compensated for through a corresponding increasing of the coating medium flow (mass flow or volume flow). If, however, the application device is rotated so that the path width is a minimum and the layer thickness is correspondingly maximal, then the increasing of the layer thickness can be compensated for in that the coating medium flow is reduced.

The above-described adjustment of the movement speed of the application device dependent upon the rotation angle of the application device can be carried out according to the present disclosure in accordance with the following formula:

$$V(\alpha)=V0/\cos(\alpha),$$

where $\alpha$ is the rotation angle between the longitudinal direction of the spray pattern and the path transverse direction, V0 is the movement speed of the application device when the rotation angle $\alpha$ between the longitudinal direction of the spray pattern and the path transverse direction is zero, $V(\alpha)$ is the adjusted movement speed at the current rotation angle $\alpha$ in order to achieve the most constant layer thickness possible.

For the painting of large component surfaces (e.g. the roof of a motor vehicle bodywork), in some implementations the present disclosure also provides that a plurality of adjacent coating paths is applied to the component surface, wherein the adjacent component surfaces should abut one another as gaplessly as possible and without overlaps in order to prevent overcoated regions and undercoated regions.

In implementations of the present disclosure for, e.g., the coating of rectangular component surfaces, parallel coating paths can be applied.

The present disclosure is also suitable, however, for the coating of component surfaces which are not exactly rectangular overall, as is usually the case with motor vehicle bodywork components. The present disclosure then provides that the coating paths applied are also not exactly rectangular, in order to adapt to the non-rectangular component surface. This can be achieved in the context of the present disclosure in that the application device is continually rotated while travelling along the individual coating paths, in order to achieve the desired path width in each case. The application device is thus rotated while travelling along each individual coating path, so that no overlapping with adjacent coating paths or gaps between the adjacent coating paths takes place.

In one exemplary implementation of the present disclosure, the application device is moved over the component surface by means of a multi-axis application robot. Such application robots are known and therefore are not described in detail herein. Such an application robot, in some implementations, is a multi-axis robot with, for example, six or seven axes and serial kinematics, wherein the application robot can optionally be mounted locally fixed or displaceable.

In such an implementation of the application robot and the application device are controlled during operation by a robot control system according to a parameter set. The parameter set can define, for example, the movement speed of the application device, the acceleration of the application device, the rotation angle of the application device, the rotation speed of the application device, the applied coating medium flow or the coating spacing.

In some implementations of the present disclosure, the parameter set is adjusted during the movement along the coating path, i.e. within a coating path.

This adjustment of the parameter set can take place, for example, continuously. Alternatively, in some implementations, the coating path is subdivided into a plurality of successive path portions which are travelled one after another, wherein the parameter set for controlling the application device and the application robot within each individual path portion is kept constant and changes from one path portion to the next.

It has been described above that the path width of the applied coating path can be adjusted in that the application device can be rotated accordingly. In the context of the present disclosure, the rotation angle of the application device is, in some implementations, therefore calculated depending upon the desired path width and the maximum width of the spray pattern along its longitudinal direction. For example, this calculation can be carried out according to the following formula:

$$\alpha=\arccos(SB2/SB1),$$

where

SB1 is the width of the spray pattern along the longitudinal direction of the spray pattern, SB2 is the desired path width of the coating path, $\alpha$ is the rotation angle between the longitudinal direction of the spray pattern and the path transverse direction.

It has been mentioned above that the parameter set for controlling the application robot and the application device can be adjusted from one path portion to the next path portion. In some exemplary implementations, this amendment takes place in a transition portion.

The rotation angle of the application device at the end of the transition portion is, in some implementations, calculated from the following formula:

$$\alpha 3=\arccos(SB3/SB1),$$

where $\alpha$3 is the rotation angle at the end of the transition portion,

SB1 is the path width at the start of the transition portion,

SB3 is the path width at the end of the transition portion.

The movement speed of the application device at the end of the transition portion, in some implementations, may be calculated from the following formula:

$$V3=V1/\cos(\alpha 3),$$

where

V3 is the movement speed of the application device at the end of the transition portion, V1 is the movement speed of the application device at the start of the transition portion, $\alpha$3 is the rotation angle of the application device at the end of the transition portion.

Along such a transition portion, the application device according to the principles of the present disclosure undergoes an acceleration which is, in some implementations, calculated with the following formula:

$$a2=(V3-V1)^2/S2,$$

where a2 is the acceleration of the application device during the transition portion, V3 is the movement speed of the application device at the end of the transition portion, V1 is the movement speed of the application device at the start of the transition portion, S2 is the length of the transition portion.

The portion length S2 of the transition portion may be calculated with the following formula:

$$S2=[\alpha 3\cdot(V3-V1)]/\omega 2,$$

where

S2 is the length of the transition portion, $\alpha$3 is the rotation angle of the application device at the end of the transition portion, V3 is the movement speed of the application device at the end of the transition portion, V1 is the movement speed of the application device at the start of the transition portion, $\omega$2 is the rotation speed of the application device on the transition portion.

The rotation speed of the application device on the transition portion may be calculated with the following formula:

$$\omega 2=V1/SB1\cdot\Delta SD\ \%\cdot 360°/\pi,$$

where $\omega$2 is the rotation speed of the application device on the transition portion, V1 is the movement speed of the application device at the start of the transition portion, SB1 is the path width at the start of the transition portion, $\Delta$SD % is the layer thickness tolerance.

It should further be mentioned that the spray pattern may be sharp-edged, so that the application device of the present disclosure may differ, for example, from rotary atomisers.

Furthermore, the spray pattern can be approximately rectangular. In the context of the present disclosure, however, other forms of spray patterns are possible, for example, elliptical spray patterns.

The coating paths may be curved in order to conform to a non-straight component edge. Furthermore, the coating paths can be, for example, convex or concave. Therefore in the coating method according to the present disclosure, the side edges of the coating paths do not have to extend parallel to one another since the path width can be influenced by the corresponding rotation of the application device.

In some implementations of the present disclosure, the application device is guided over the component surface so that at the impact point of the coating medium stream, the coating medium stream is oriented substantially perpendicularly to the component surface.

Finally, the present disclosure also relates to a corresponding coating installation.

In such an implementation, a robot control system rotates the application device about the stream axis during the movement along the coating path, so that the rotation angle between the longitudinal direction of the spray pattern and the coating path changes along the coating path.

The expression robot control system used in the context of the present disclosure is herein to be understood as comprising, e.g., all hardware and software components which serve for the control of the application device and the application robot.

The robot control system can be concentrated centrally in a single assembly. Alternatively, however, it is possible to distribute the different functions of the robot control system among a plurality of assemblies which communicate with one another.

The totality of control processes of the robot control system is, in some implementations, provided automatically by a higher-order software tool. Provided with input of the component geometry to be coated and certain parameters (e.g. minimum and/or maximum permissible movement speed, layer thickness tolerance to be maintained, maximum permissible rotation angle of the applicator, etc.), based upon the mathematical calculations described, the software tool independently calculates the optimum path course with corresponding rotation angles and the suitable orientation of the application device.

DRAWINGS

Figure 1:
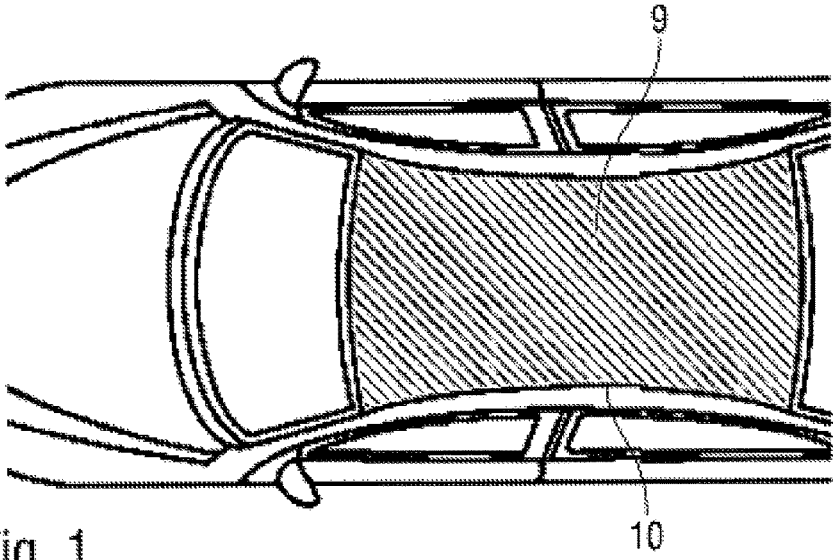
Figure 2:
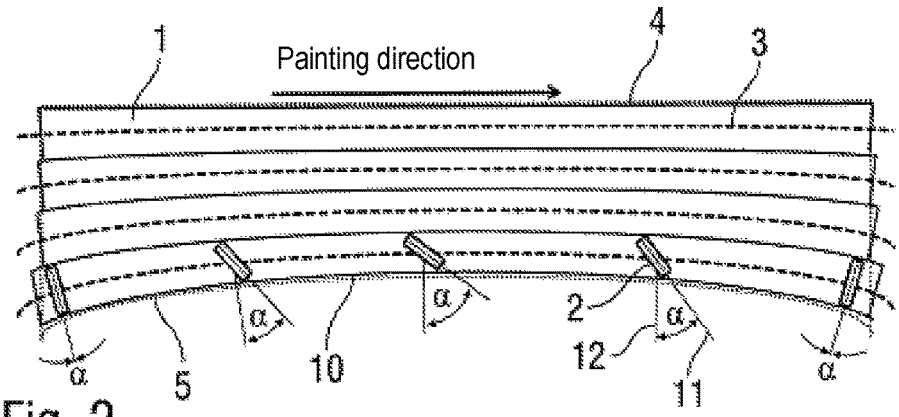
Figure 3:
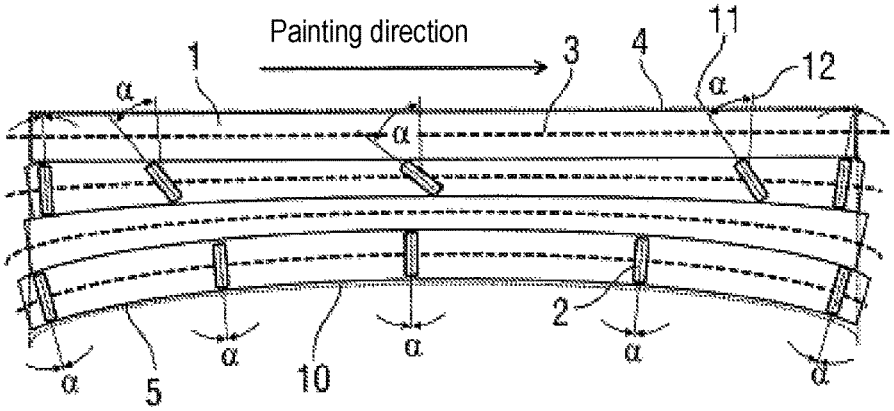
Figure 4:
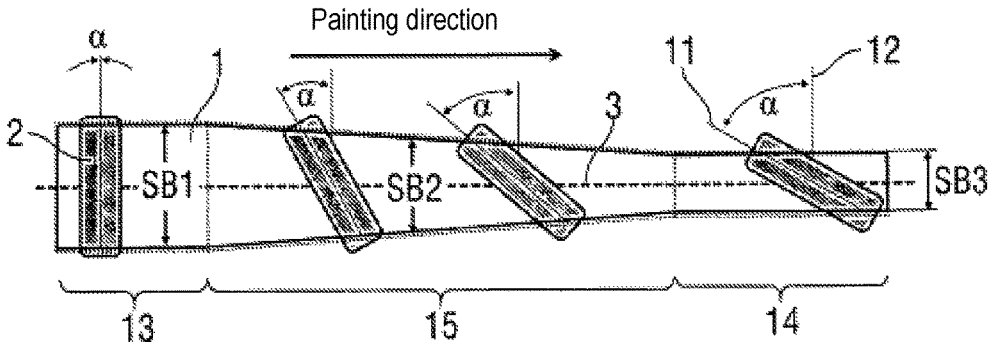
Figure 5:
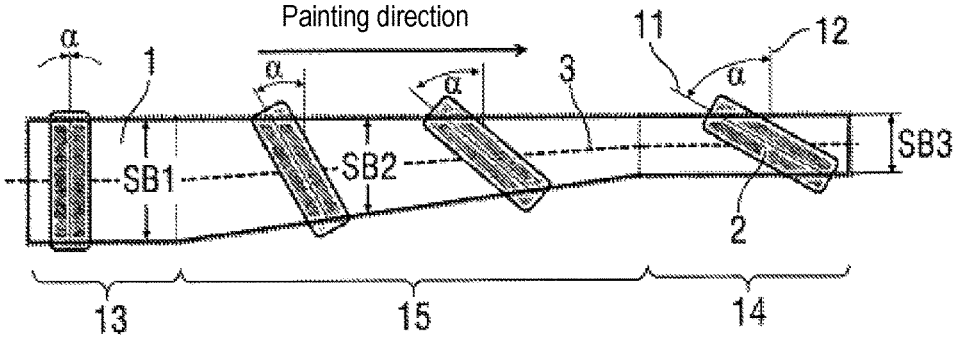
Figure 6:
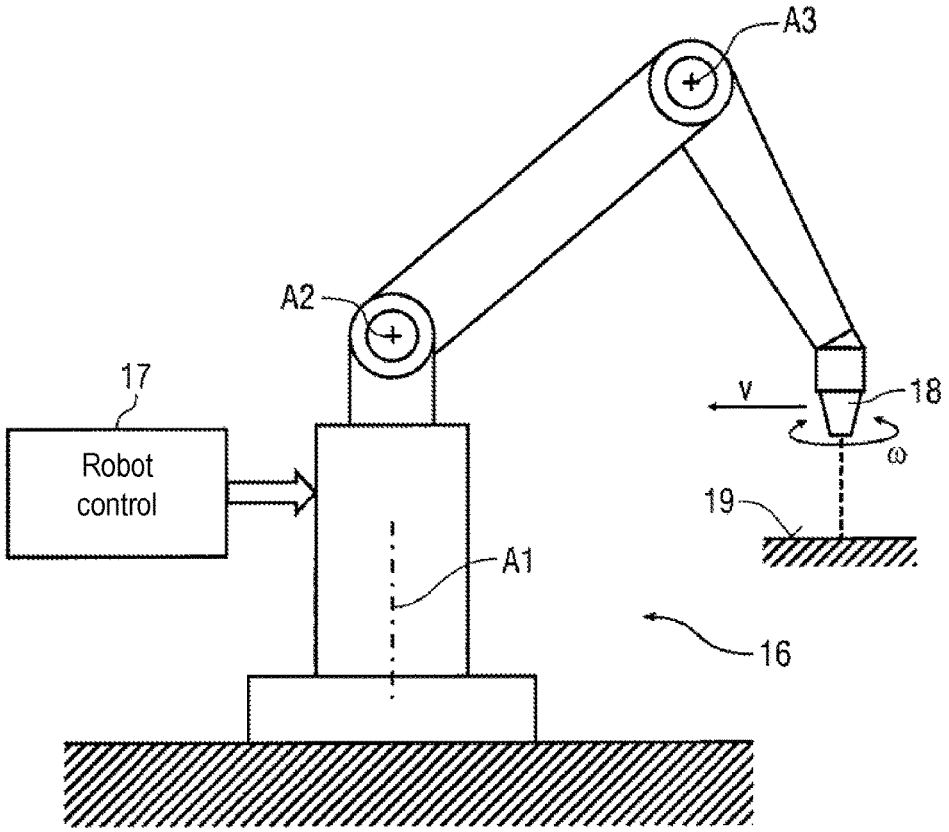

The present disclosure is further explained below in the description, making reference to the drawings. In the drawings:

FIG. 1 shows a plan view onto a roof of a motor vehicle bodywork, wherein the roof is to be painted, FIG. 2 shows a schematic representation of adjacent painting paths for painting the roof of the motor vehicle bodywork of FIG. 1 in the lower region of FIG. 1, FIG. 3 shows a modification of FIG. 2, FIG. 4 shows a schematic representation of a transition portion of a painting path, FIG. 5 shows a modification of FIG. 4, FIG. 6 shows a schematic representation of a painting installation according to the present disclosure, FIG. 7 shows a schematic representation of painting with parallel painting paths according to the prior art, which leads to uncoated regions, and FIG. 8 shows a schematic representation of adjacent painting paths with overlaps between the adjacent painting paths according to the prior art.

DESCRIPTION

FIGS. 1 and 2 show a schematic representation of painting an exemplary vehicle component, a roof 9 of a motor vehicle bodywork by an application device which generates an approximately rectangular spray pattern 2, as shown in FIG. 2.

The painting of the roof 9 is configured to accommodate curved side edges 10 of the roof 9. It is therefore not possible simply to paint the roof 9 with parallel coating paths 1, since this would lead to uncoated regions 6 (see FIG. 7) or to overcoated regions 8 (see FIG. 8).

According to the present disclosure, the application device is rotated along the path course 3, specifically about the stream axis of the applied coating medium stream, so that the spray pattern 2 rotates accordingly. Thus, FIG. 2 shows a rotation angle $\alpha$ between the longitudinal direction 11 of the elongate spray pattern 2 and a path transverse direction 12, wherein the path transverse direction is oriented perpendicularly to the path course 3 in each case. From FIG. 2, it is apparent that the rotation angle a of the spray pattern 2 is adjusted along the path course 3 in order to adapt the path width so that the coating paths 1 abut one another without gaps and without overlaps and thereby conform to the component edges 10.

FIG. 3 shows a modification of FIG. 2 with another adjustment of the rotation angle $\alpha$ along the path course 3. Herein, however, the whole roof 9 is painted without overlaps and without gaps between the adjacent coating paths 1.

FIG. 4 shows a schematic representation of the transition from one path portion 13 with a maximum path width SB1 to a path section 14 with a substantially smaller path width SB3.

Situated herein between the two path portions 13, 14 is a transition portion 15 with a path width SB2 which is adjusted from a value SB2=SB1 at the start of the path portion 15 to a value SB2=SB3 at the end of the transition portion 15.

For this adjustment of the path width SB2, the spray pattern 2 is rotated in each case, as shown in FIG. 4, wherein different rotation angle states are shown along the path course 3.

In the transition portion 15, not only one change of the rotation angle $\alpha 2=\alpha 1=0°$ to $\alpha 2=\alpha 3$ takes place. Furthermore, in the transition portion 15, the movement speed of the application device along the path course 3 is also adjusted. It is thereby achieved that the layer thickness remains uninfluenced by the change of the rotation angle a between the path portion 13 and the path portion 14. Thus, the movement speed V3 in the path portion 14 is calculated dependent upon the movement speed V1 in the path portion 13 and the rotation angle $\alpha 3$ in the path portion 14 according to the following formula:

$$V3=V1/\cos(\alpha 3).$$

In the transition portion 15, the application device therefore undergoes an acceleration a2, which is calculated as follows:

$$a2=(V3-V1)^2/S2,$$

wherein S2 is the length of the transition portion 15 along the path course 3.

In the transition portion 15, the application device—and thus also the spray pattern 2—is rotated at a rotation speed $\omega 2$ which depends on the layer thickness tolerance $\Delta$SD %, the movement speed V1 in the path portion 15 and the path width SB1 in the path portion 13 and can be calculated according to the following formula:

$$\omega 2=V1/SB1\cdot\Delta SD\ \%\cdot 360°/\pi.$$

FIG. 5 shows a modification of FIG. 4 so that for the avoidance of repetition, reference is made to the above description. A peculiarity herein lies therein that the path course 3 is not exactly linear, but undergoes a lateral offset in the transition portion 15.

Finally, FIG. 6 shows, in a schematic form, a painting installation according to the present disclosure to carry out the painting method according to the present disclosure as described above.

The painting installation includes a multi-axis painting robot 16 which can be realised in a conventional manner and therefore need not be described in greater detail.

The painting robot 16 is controlled by a robot control system 17 wherein the robot control system 17 also controls an application device 18 which is positioned in front of the painting robot 16. The robot control system 17 controls the painting robot 16 such that the application device 18 is guided in adjacent coating paths over a component surface 19 to be painted, as described in detail above.

In this movement of the application device 18, the robot control system 17 controls the painting robot 16 such that the application device 18 can be rotated about a stream axis 20 of the coating medium stream in order to be able to adapt the path width of the applied coating path, as previously described in detail above.

The present disclosure is not restricted to the above-described exemplary implementations. Rather a plurality of variants and modifications is possible which also make use of the present disclosure.

The invention claimed is:

1. A method for coating components, comprising:

moving an application device along a pre-determined coating path over a component surface to be coated, applying a coating medium stream with the application device onto the component surface while the application device is moved over the component surface, wherein the coating medium stream is rotationally asymmetrical relative to its stream axis and generates on the component surface an elongate spray pattern with a longitudinal direction, and rotating the application device about the stream axis relative to the coating path during the movement of the application device along the coating path, wherein rotation of the application device changes the angular position of the longitudinal direction of the spray pattern relative to a path transverse direction the application device is rotated about the stream axis through a rotation angle between the longitudinal direction of the spray pattern and the path transverse direction in order to achieve a desired path width, the application device is moved at a movement speed along the coating path, the application device applies the coating medium with a coating medium flow, at least one of the movement speed and the coating medium flow is adjusted dependent upon the rotation angle to provide a desired coating layer thickness, wherein the adjustment of the movement speed of the application device dependent upon a current rotation angle of the application device is carried out in accordance with the formula:

$$V(\alpha)=V0/\cos(\alpha)$$

where V0 is the movement speed of the application device when the rotation angle between the longitudinal direction of the spray pattern and the path transverse direction is zero, $\alpha$ is the current rotation angle between the longitudinal direction of the spray pattern and the path transverse direction, $V(\alpha)$ is the adjusted movement speed at the current rotation angle.

2. The method according to claim 1, wherein the component surface is nonrectangular, the coating medium is applied along a plurality of coating paths on the component surface, and during the movement along the coating paths, the application device is rotated about the stream axis in order to rotate the elongate spray pattern such that a desired path width is achieved.

3. The method according to claim 1, wherein the application device is moved by a multi-axis application robot over the component surface, the operation of the application device and of the application robot is controlled by a parameter set, and the parameter set is adjusted during the movement of the application device along the coating path.

4. The method according to claim 3, wherein the parameter set comprises at least one of the following parameters for controlling the application device and the application robot:

a movement speed of the application device along the coating path, an acceleration of the application device along the coating path, a rotation angle of the application device between the longitudinal direction of the spray pattern and the path transverse direction, a rotation speed of the application device, a coating medium flow, and a coating spacing between the application device and the component surface.

5. The method according to claim 3, wherein the parameter set for controlling the application device and the application robot along the coating path is continuously adjusted.

6. The method according to claim 3, wherein the coating path is subdivided into a plurality of successive path portions situated one after another, and wherein the parameter set for controlling the application device and the application robot is kept constant within the individual path portions and is adjusted between the path portions.

7. The method according to claim 1, further comprising:

determining a desired width of the coating path, and determining a rotation angle between the longitudinal direction of the spray pattern and the path transverse direction corresponding to the desired width of the coating path with the following formula:

$$\alpha=\arccos(SB2/SB1),$$

where

SB1 is a width of the spray pattern along the longitudinal direction of the spray pattern, SB2 is the desired width of the coating path, $\alpha$ is the rotation angle between the longitudinal direction of the spray pattern and the path transverse direction.

8. A method for coating components, comprising:

moving an application device along a pre-determined coating path over a component surface to be coated, applying a coating medium stream with the application device onto the component surface while the application device is moved over the component surface, wherein the coating medium stream is rotationally asymmetrical relative to its stream axis and generates on the component surface an elongate spray pattern with a longitudinal direction, and rotating the application device about the stream axis relative to the coating path during the movement of the application device along the coating path, wherein rotation of the application device changes the angular position of the longitudinal direction of the spray pattern relative to a path transverse direction wherein the application device is continuously rotated during the movement along the coating path, wherein the spray pattern is sharp-edged, and wherein the application device is moved along a plurality of coating paths across the component surface, and at least one of the coating paths is curved.

9. The method according to claim 8, wherein the spray pattern is substantially rectangular.

10. The method according to claim 8, wherein he application device is guided over the component surface such that the coating medium stream is oriented substantially perpendicularly to the component surface at the interface therebetween.

* * * * *